United States Patent [19]

Schumacher

[11] 3,977,875

[45] Aug. 31, 1976

[54] METHOD FOR MODIFYING VESICULAR IMAGES

[75] Inventor: Ernst Schumacher, Bremgarten, Switzerland

[73] Assignee: Ciba-Geigy AG, Basel, Switzerland

[22] Filed: Oct. 9, 1974

[21] Appl. No.: 513,450

Related U.S. Application Data

[60] Continuation-in-part of Ser. No. 370,896, June 18, 1973, abandoned, which is a division of Ser. No. 123,821, March 12, 1971, abandoned.

[30] Foreign Application Priority Data

Mar. 13, 1970 Switzerland ..... 3822/70

[52] U.S. Cl. ..... 96/48 R; 96/17; 96/21; 96/28; 96/30; 96/35.1; 96/36.2; 96/48 HD; 96/49; 250/316; 250/317; 250/318; 427/130; 427/145; 427/148; 427/149; 427/163; 427/261; 427/271; 427/273; 428/29

[51] Int. Cl.[2] ..... G03C 5/00; G03C 7/00

[58] Field of Search ..... 96/48, 49, 27 R, 75, 96/91 R, 91 N, 115 P, 35.1, 45.2, 36.2; 427/145, 261, 130, 148, 149, 163, 271, 273; 250/316, 317, 318

[56] References Cited

UNITED STATES PATENTS

| | | | |
|---|---|---|---|
| 2,911,299 | 11/1959 | Baril et al. | 96/49 |
| 2,996,381 | 8/1961 | Oster et al. | 96/49 |
| 3,032,414 | 5/1962 | James et al. | 96/49 |
| 3,093,478 | 6/1963 | Peterson | 96/49 |
| 3,104,175 | 9/1963 | Marx et al. | 427/273 |
| 3,260,599 | 7/1966 | Lokkew | 96/75 |
| 3,536,490 | 10/1970 | Hochberg | 96/49 |
| 3,607,273 | 9/1971 | Kinney | 96/35 |
| 3,615,476 | 10/1971 | Cassiers et al. | 96/27 R |
| 3,615,486 | 10/1971 | Delzenne | 96/27 R |
| 3,708,295 | 1/1973 | Schumacher | 96/36.2 |
| 3,816,133 | 6/1974 | Weyde | 96/48 HD |

FOREIGN PATENTS OR APPLICATIONS

| | | | |
|---|---|---|---|
| 2,084,439 | 12/1971 | France | 96/49 |
| 645,825 | 9/1945 | United Kingdom | 96/91 R |
| 1,091,501 | 11/1967 | United Kingdom | 96/27 R |

*Primary Examiner*—Charles L. Bowers, Jr.
*Attorney, Agent, or Firm*—Joseph G. Kolodny; Edward McC. Roberts; Prabodh I. Almaula

[57] ABSTRACT

A method for modifying vesicular images into non-scattering images is provided, which comprises opening the closed bubbles of the vesicular image to form an open-bore image by allowing at least one organic solvent which attacks the thermoplastic bubble walls of the vesicular image to act on the latter, optionally making the image wettable with a surfactant introducing the image substance into the open pores by treatment with a solution or dispersion of the image substance and, optionally removing any remaining gas bubbles or pores by heat or solvent treatment.

7 Claims, No Drawings

METHOD FOR MODIFYING VESICULAR IMAGES

This is a continuation-in-part of our patent application Ser. No. 370,896, filed June 18, 1973, now abandoned, which in turn is a divisional of our patent application Ser. No. 123,821, now abandoned, filed Mar. 12, 1971.

The invention relates to a method of modifying vesicular images, particularly of transforming vesicular images into non-diffusive or non-light-scattering images, the closed gas bubbles of the vesicular images being replaced by a solid or liquid image substance. The method is characterised by the fact that a liquid consisting of an image substance or containing such a substance is allowed to penetrate the image material in such a way that it deposits in the latter in dependance on the original frequency of the bubbles in the vesicular image.

In contrast to other known methods in which light-absorbing images are formed, the vesicular methods produce light-diffusing images. The light-sensitive recording materials for the vesicular method generally contain on a carrier a substrate (bonding agent) in which are dispersed light-sensitive compounds, especially those sensitive to ultra-violet light, which produce image-wise light-diffusing centres after exposure and development. These light-diffusing centres consist of microscopic, closed gas bubbles, which are generally stably embedded as a solid foam in a thermoplastic layer. The thermoplastics are, for example polymers such as polyvinylidene chloride, polymethacrylonitrile, polyamine, polyurethane or polystyrene, copolymers made from acrylonitrile with ethyl acrylate or vinylidene chloride with or without addition of modifiers such as oligomers, epoxides or methyl methacrylate. However, the method according to the invention is not dependent on thermoplastic behaviour of the substrate. Other substrates suitable for vesicular photography such as thermosetting plastics or thermoelastic layers as well as swelling hydrophilic gels such as gelatin also come into consideration. The macromolecular substrate layer adheres to a carrier made, for example, from polyester or paper. The light-sensitive substances in this material are generally diazonium salts, which liberate nitrogen during photo-decomposition, the nitrogen in turn causing bubble formation during thermal development. Vesicular images are normally obtained by the following three methods:

| Method | Exposure (UV, possibly also visible light) | Development | Fixing |
|---|---|---|---|
| 1 | Image-wise | E.g. 2 seconds at 130°C | Diffuse total exposure with UV at room temperature |
| 2 | Image-wise latent image diffuses away | Xenon flash | — |
| 3 | Diffuse total exposure | Image-wise exposure with heat | Spontaneous at room temperature |

The vesicular images can be produced thermally, e.g. by a hot tip, a hot relief image or by laser beams. There are also vesicular images which are obtained by pressure.

Although these vesicular images are produced by a very simple, dry process, this type of photography has not been adopted in many fields. This can be explained by three important reasons: firstly the maximum density and characteristic curve of light-diffusing images are dependent on the lighting and angle of observation; secondly, their resolution capacity is limited by the rapidly diminishing diffusion factor of gas bubbles, the diameter of which is equal to or less than twice the light wavelength; thirdly, the granularity exhibits a striking anomaly with a maximum in the medium densities which are most important for the image.

The present invention relates to a simple method, which eliminates many of the disadvantages of the known vesicular methods.

Basically, there are two variants of the method according to the invention. The first variant is characterised by the fact that a solid or liquid image substance dissolved in a lipophilic organic solvent, which is capable of causing the hydrophobic thermoplastic bubble walls of the vesicular image to swell, is allowed to act on the vesicular image so that the solution of the image sustance is enriched at the image areas rich in bubbles, the excess adhering solution removed, the material dried and, if necessary, any remaining gas bubbles or pores subsequently removed by heat or solvent treatment.

The second variant is characterised by the fact that the closed bubbles of the vesicular image are opened to form an open-pore image by allowing at least one organic solvent which attackes the thermoplastic bubble walls of the vesicular image to act on the latter, if necessary the image is made wettable with a surfactant, the image substance is introduced into the opened pores by treatment with a solution and, if necessary, any remaining gas bubbles or pores are subsequently removed by heat or solvent treatment.

Various substances, which are directly or indirectly suitable for image production, can be used for application of the method according to the invention. The image substances are preferably those which are capable of absorbing electro-magnetic radiation at wavelengths of 250 to 800 nm. It is preferable to use an image substance, in particular a solid one, which is a dyestuff, an ultra-violet absorber, a fluorescent substance, an organometallic compound, a metallic salt, a surfactant or a distillable oil.

Optical brighteners are preferably used as fluorescent substances.

Special effects can be achieved, e.g. for exhibition purposes with virtually colourless images made from fluorescent substances, insofar as they are placed over visible images.

Image sustances which absorb in the visible spectrum, i.e. dyestuffs, including fluorescent dyestuffs, are preferably used.

If metallic salts are used as image substances, these are preferably water-soluble, and it is advantageous to operate in accordance with the second variant. The water-soluble metallic salts can be transformed into light-absorbing substances not readily soluble in water by subsequent chemical reaction, e.g. into an oxide, sulphide, organometallic complex or the metal itself. The metal image can subsequently be intensified by a physical developer.

Water-soluble dyestuffs are, of course, also suitable for the second variant.

In the preferred form the second variant of the method according to the invention is carried out in such a way that the open-pore image is treated with a surfactant and an aqueous solution of the image substance. Anionic, cationic and non-ionic surfactants may be used particularly anionic surfactants for cationic image substances, and cationic surfactants for anionic image substances.

The method employed with metallic salts as image substances can be used, for example, for manufacture of magnetic microfilm images.

Other metal compounds, e.g. gold, silver, copper or nickel compounds, can also be used as image substances and reduced to metal or precipitated in a different way according to the image required. Metal images of this kind can be intensified chemically or electrolytically and developed into conductive masters, e.g. so-called printed circuits.

When proceeding in accordance with the first variant of the method according to the invention, it is preferable to use lipophilic solvents to make the bubbles swell and to dissolve the image substance.

In the second variant of the method according to the invention it is preferable to use a lipophilic solvent for opening the bubbles, but a hydrophilic image substance or a hydrophilic solution of the latter.

Depending on the consitution, molecular weight and degree of cross-linking of the macromolecular bonding agent of the vesicular substrate, suitable lipophilic organic solvents for the first variant can be found in various classes of materials. Solvents which cause the substrate to swell quickly without it being noticeably dissolved are preferred. If necessary the required properties can be obtained by homogenous mixing of two or more liquids, at least one of which is a good solvent for the polymer and at least one other a non-solvent. Many solvents (solvent mixtures) suitable for the first variant can be found in the table "Solvents and Nonsolvents for Polymers", p. IV, 185-234 of the "Polymer Handbook", J. Brandrup and E. H. Immergut (ed.), New York 1966.

The specified solvents are suitable for the following substrates, e.g. in the first variant of the method according to the invention:

Polyvinylidene chloride as main component: methylene chloride, tetrahydrofuran, 1,2-dichloro- and trichlorobenzene, cyclohexanone, 1,1,1-trichloro ethane, dioxane, ethyl acetoacetate, 2-ethoxy-ethanol, 2-propoxy-ethanol, whereby the rates of transformation decrease in this order. Mixtures of these solvents can also be used in the region of room temperature; methylene chloride is preferred for rapid transformations, 2-ethoxy-ethanol for slower ones.

Polymethacrylo-nitrile: methylene chloride, acetone, mixtures of both, methylene chloride/ethanol, dimethyl formamide/ethanol, dimethyl sulphone, ethyl acetoacetate, cyclohexanone, acetonitrile, nitromethane; methylene chloride and acetone are preferred.

Polystyrene: cyclohexane/acetone, benzene/methanol, methylene chloride, methyl ethyl ketone, butyl acetone; cyclohexane/acetone mixtures are preferred.

Epoxides (low molecular weight, e.g. SHELL EPICOTE 1001): ethyl acetate, dimethyl formamide/methyl ethyl ketone, benzene/ethanol, dioxane/ethoxyethanol; ethyl acetate is preferred.

In the case of the first variant of the method according to the invention it is important to ensure that these lipophilic solvents are able to penetrate, i.e. diffuse into, the bubble-containing image areas as quickly as possible without the gas of the bubbles being visibly liberated, but with considerable swelling of the bubble structure. In image areas that are deficient in bubbles or unexposed this process is much less pronounced than in the areas rich in bubbles with a large inner surface and thin polymeric bubbles walls.

In continuous methods solid solvents melting between 40° and 100° C can be used, also at room temperature, instead of the solvents just mentioned. Waxes, low-polymer thermoplastics or gels with alcoholic, ether, ketonic and/or ester groupings may be employed.

With the first variant it is advisable to proceed in such a way that the concentration of the image substance in the lipophilic solvent is 0.1 to 10, preferably 0.8 to 1.5% by weight. The solution of the image substance is allowed to act on the vesicular image generally at a temperature of 2° to 100° C, preferably 15° to 25° C. Depending on the solvent, concentration and temperature, the image substance solution is allowed to act on the vesicular image for 3 seconds to 20 minutes.

With constant image material the colour density in the exposed and unexposed image areas is dependent on time, image substance concentration, solvent and temperature. The image layer is completely coloured after a very long treatment time. An optimum difference in the density of areas of maximum and minimum exposure is obtained if these variables are suitably selected.

The excess adhereing solution of the image substance is advantageously removed by washing with the same solvent, in which the image substance is dissolved, and subsequent flushing with a highly volatile organic solvent which is inert vis-a-vis the substrate of the vesicular image. Solvents particularly suitable for this purpose are, for example, ethanol or carbon tetrachloride. The maximum density can still be substantially influenced by changing the period of washing with the first solvent.

The image transformed in this way is suitably dried in a heating cabinet or hot-air stream for 2 seconds to 5 minutes at 60°–30° C.

Image substances with diffusion tendencies can be fixed by short thermal treatment at about 50° C above the glass transition temperature of the thermoplastic substrate. In this case the thermoplastic is cross-linked and glossy on the surface, even at the image areas of the original bubbles.

If the method according to the invention is correctly executed an image completely free of bubbles, which faithfully reproduces the density curve of the original image, but has a maximum density and contrast independent of the optics of the lighting and viewing system (in transmission), is obtained. When dyestuffs are used as image substances the minimum density in transmission may be less than 0.1 above the density of the carrier in the case of maximum densities above 2.5. Depending on the type of the image substance, stable colourings according to the image, which neither diffuse nor exude, are obtained in this way.

If ultra-violet absorbers are used as image substances, they produce UV-absorbing images which can be used as UV protective filters and represent images hardly discernible by the eye and, for example, can easily be superimposed on a coloured or black-and-white image, but reproduce additional information when irradiation with UV.

If dyestuffs are used as image substances, they are primarily dyestuffs soluble in lipophilic solvents in the first variant of the method, and water-soluble dyestuffs with maximum fastness to light in the second variant. These dyestuffs are also non-diffusive, and the projection density of the original vesicular image can be increased by a factor of 2 to 5, i.w. greater sensitivity achieved. For example, original X-ray films can be copied by the vesicular method and brought to a density as in the original by the present method. The known vesicular method only produces copies with weak contrast and lack of detail.

In the second variant lipophilic organic solvents are required for opening the bubbles. Depending on the constitution, molecular weight and degree of cross-linking of the vesicular substrate, suitable solvents can be found in different classes also in this case. Solvents which penetrate rapidly and open the bubbles without noticeably dissolving the substrate are preferred. For the rest, the general comments on the solvents used in the first variant apply to selection of these solvents.

examples of suitable lipophilic organic solvents for opening the bubbles in accordance with the second variant of the method are as follows:

For polyvinylidene chloride as main component of the substrate: acetone, methyl ethyl ketone, dimethyl fomamide, pentachloroethane, tetrahydrofuran (at higher temperature), ethyl acetate, 2-methoxy ethanol or mixtures of these solvents with each other or with methylene chloride.

For polymethacrylonitrile: dimethyl formamide, dimethyl sulphone, cyclohexanone, pyridine, furfural, methylene chloride.

For polystyrene: methylcyclohexane, 1,1,1-trichloroethane, pentachloroethane, tetrahydrofuran, ethyl acetate, dioxane.

For epoxides: methyl ethyl ketone, methanol (higher temperature), acetonitrile, dimethyl formamide (higher temperature), xylene.

It is advantageous to open the bubbles of the vesicular image with the vapours of these lipophilic solvents. The method in which the bubbles are opened by immersion in the vapour of acetone, methylene chloride or dimethyl formamide for 1 to 20 seconds is particularly valuable.

It is important that these lipophilic solvents for the second variant or their mixtures are capable of penetrating the bubble structure rapidly i.e. within 10 to 15 seconds, thereby liberating the gas and thus forming an open-pore image-wise structure. These solvents always act on the polymer layer, which also increase the interfacial tension of the bubble walls and therefore cause the bubbles to burst. This process must take place more quickly than dissolution of the polymer layer. Some solvents; e.g. methylene chloride, can be used in both varaiants for most substrates. In this case the swelling process required for the first variant (with solvent plus image substance takes place very quickly, so that the transformation process is concluded in a few seconds. In about 10 to 20 seconds the bubbles are liberated, open pores formed, and thus the second variant of the method according to the invention beomes possible.

Vesicular image with open pores have a cloudy appearance. They also differ from those of the first variant by the important property that the image areas preferably absorb surfactant from aqueous solutions of aromatic, cationic or non-ionic wetting agent. Water-soluble image substances with a very good preference for unexposed image areas can then be introduced into the open pore structure.

After introduction of the image substance it is advisable to remove excess adhereing image substance solution by briefly flushing with water.

The image substance can then be precipitated and/or fixed by closing the pores in that they are allowed to collapse by heat treatment or treatment with a highly volatile organic solvent such as acetone, methyl ethyl ketone, dioxane or methylene chloride, preferably as vapour, so that they close, and subsequently dried with hot air. A smooth, glossy surface which does not diffuse light is obtained by aftertreatment of this type.

According to the invention it is also possible to copy a silver negative obtained with a green filter from a colour transparency on to a vesicular film. This positive is now coloured yellow in the described way up to a maximum density of 0.6 and then produces an excellent mask film for better colour separation of green and blue.

Accordingly, light-diffusion images which are produced in an elegant manner without wet chemistry can easily be transformed into light-absorbing or light-fluorescing images without the optical disadvantages.

Sensitivity and maximum density can be increased, while the resolution capacity is retained. Compared to coloured diazotype films, this method has the advantage that any required colour can be obtained with a single film material by colouring, and the sensitivity increased substantially by 20 to 50 times.

Particularly important applications of the first or second variant of the method according to the invention concern monochrome miniature cinematography. Film 16 mm or still smaller films, e.g. Single 8, Super 8, must be projected with a relatively wide aperture to ensure that sufficient luminance is produced on the screen. Under these conditions the contrast ratio of vesicular films is quite inadequate. After image transformation according to the invention, however, images with a density between 0.02 (over polymer layer plus carrier) and about 3.0, and a gamma value between 1.0 and 1.3 are easily obtained. These values have not yet been achieved in the diazotype process.

Another important application concerns the transformation of lithographic films by the vesicular method. Although these films (e.g. "Kalvalita" of the Kalvar Corporation, New Orleans) are very good copies of the original silver negatives, they cannot be further exposed, e.g. on an offset master, without considerable disadvantages. To begin with a vesicular image copied only by contact produces a copy with hardly any contrast, because the laterally diffused light also contributes to exposure of the offset master on account of the small distance. To reduce this effect the Kalvalita films up to a density of 0.6 must be provided with a light-absorbing dyestuff (anti-halo effect) with the result that the necessary exposure time is quadrupled. However if, the vesicular image is transformed by the first or second variant of the method according to the invention into an image, which absorbs the ultra-violet light in particular and has a vanishingly small proportion of scattered light, sharply defined copies of screen or line images which can be copied without any loss of detail are obtained. In addition, the etching effect required by offset printers can also be achieved in the case of the image transformation. An overexposed vesicular copy of a silver negative (or, according to the process, positive) screen image is produced. This image is then transformed, for example, into a neutral grey dyestuff image. The screen dots can be toned down as required by shorter or longer treatment in the same solvent as that in which the image substance was dissolved.

To carry out image transformation in accordance with both variants, a number of trays or tanks with mechanical movement of the liquid and containing the solvents with image substances as well as the baths with washing solutions are sufficient in the simplest case. A continuous application of the method according to the invention can be materialised, for example, in a simple roll developing machine. The exposed and developed vesicular film is guided into a through containing a solvent according to the first variant, in which for example, a dyestuff is dissolved. Here the film is gripped by two rollers and pulled out, and then treated on the same principle in a washing bath according to the variants mentioned in the examples. In this way virtually dry, transformed images can be produced in a few seconds.

Another variant for continuous transformation can be illustrated as follows:

A ketone or ester wax, which melts at 40° to 60° C and is applied in coloured form on a carrier, e.g. paper, textile fabric, elastomer or metal strip, is used as solvent. The vesicular film and carrier strip are pressed together and passed over a hot roller, e.g. with a temperature of 60° C, whereby coloring of the film is carried out. The film and carrier are then separated, the latter regenerated if necessary, and excess solvent wiped off the former with cotton wool or soft paper. This simple device can be attached to an automatic vesicular film exposing and developing machine, thus permitting automatic and continuous transformation of the diffuse image film into a light-absorbing film.

Suitable vesicular film materials for working according to the inventive method are e.g. various Kalvar type films of Kalvar Corporation, New Orleans. More particularly those of the type shown in Example 1 of U.S. Pat. No. 3,032,414 (Kalvar film type 10 and paper type 90) and in Example 2 of U.S. Pat No. 3,161,511 (Kalvar film type KDR 17) are mentioned. Kalvar film type 16 is of the type as shown in Example 1 of U.S. Pat. No. 3,032,414 with a polyacrylonitrile resin as binder.

In a special embodiment of the present method thermally decomposable organometallic compounds, which can be transformed into a metal image, after drying of the organometallic image, by heating are used as image substances. Suitable organometallic compounds are, for example, compounds of silver, gold, nickel, copper or tin. In this case the compounds are, for example, nickel tetracarbonyl bis-triphenyl-phosphine-gold(I)chloride, pyridino tribromo-gold(III) or diethyl tin.

These metallic compounds are decomposed into metal images preferably at 60° to 150° C, whereby the resulting metals melt into the thermoplastic depending on the temperature.

The resulting metal image can be subsequently intensified by physical development.

The images produced by the method according to the invention can be used still further, e.g. for manufacture of two-colour images. Various methods can be used in this case. Basically, the procedure consists of exposure with ultra-violet radiation either diffusely or imagewise, after introduction of the image substance, thermal development to a vesicular image corresponding to the second exposure and introduction of an image substance into this image.

A preferred method consists in applying the first image substance according to variant 1 and the second image substance according to variant 2 of the method or vice versa.

A further embodiment of the method according to the invention consists in allowing an oil, which is distillable at higher temperatures, to enter the closed bubbles or open pores. "Oil" in this case is interpreted as the same substances described in German Pat. No. 1,263,031. If the vesicular image transformed in this way is heated in contact with an absorbent paper oil images that can be developed are produced on this paper. In this way up to 200 copies can be pulled from a transformed vesicular image as thermographic copying original.

If another infra-red-absorbing image is added to this sandwich consisting of paper and oil-impregnated vesicular image, copies which combine the details of the vesicular image original and those of the infra-red-absorbing image are obtained. For example, 200 copies of letters with identical contents and different addresses can be produced in this way.

The oil condensed on the absorbent sheet can be developed by dyestuffs known from xerography or by ferromagnetic substances with a particle size of 4 to 17$\mu$. This oil may also be a reactive compound such as a phenol, a naphthol, a 3-pyrazolidione, a derivative of an N,N-dialkylphenylene diamine or of the hydroxylamine, which reacts with suitable reagents in the absorbent sheet with formation of coloured compounds.

A further interesting application of the method according to the invention consists in the manufacture of coloured images from monochrome colour separations, e.g. blue, green, red and black, are copied individually on to a vesicular film, which is preferably sensitive to long-wave ultraviolet light, and developed in the usual manner. The different separation copies are then coloured by the method according to the invention with the corresponding solutions, of, for example, a yellow, magenta, cyan and black dyestuff according to the image. The multi-colour transmitted light image is obtained by superimposing the different separations.

Another way of using the colour separations obtained in this way is to place them in a frame and transfer them by heat treatment one after the other on to a carrier, e.g. paper, textile fabric or an opaque plastic foil, and thus obtain a multi-colour reflected light image. A so-called "stripping layer" between the carrier and thermoplastic layer has proved advantageous in this application.

If the colour pigments customary in the offset or gravure trade or dyestuffs which simulate them spectrally, are used for colouring the vesicular images, the copies of the colour separations can be used for manufacture of so-called "colour proofs", especially if the colour separation copies are transferred on to printing papers.

The coloured partial images or thermally transferred superimpositions can be made permanent by treatment with protective varnishes or chemical after-treatment.

In variant 2 of the method, treatment with a polar solvent such as an alkanol, e.g. methanol or ethanol, after treatment of the closed bubbles with a lipophilic solvent, has proved advantageous.

The following Examples will serve to illustrate the invention:

EXAMPLE 1

A freshly developed half-tone positive on a commercial vesicular film (Kalvar film, type 10) is immersed for 15 seconds in a moving solution of 2-ethoxyethanol.

The still moist film is then placed in a 1% dyestuff solution of Cerese yellow GRN (Colour Index No. 21230) in 2-ethoxy-ethanol.

At room temperature this dyestuff diffuses selectively into the system of closed bubbles after 6 minutes.

After 9 minutes the colouring process is concluded; the yellow dyestuff changes intensively to red after diffusion. The film is thoroughly washed three times in quick succession for 10 seconds with a fresh solution of 2-ethoxy-ethanol.

The last treatment is followed by repeated immersion of the film in carbon tetrachloride to wash the remaining dyestuff solution off the material. The final clearing takes place in clean carbon tetrachloride. The film is subsequently dried for 15 minutes in a drying cabinet with air circulation at 30° C.

A positive red image is obtained.

EXAMPLE 2

A freshly developed half-tone positive on a commercial vesicular film (Kalvar film, type 10) is immersed for 15 seconds in a moving solution of 2-ethoxy-ethanol.

The still moist film is then placed in a 1% dyestuff solution of Cerese yellow GGN (Colour Index No. 110121) in 2-ethoxy-ethanol.

At room temperature this dyestuff diffuses selectively into the system of closed bubles after 6 minutes.

After 10 minutes the colouring process is concluded; the yellow shade changes intensively to red after diffusion. The film is thoroughly washed three times in quick succession for 10 seconds with a fresh solution of 2-ethoxyethanol.

The last treatment is followed by repeated immersion of the film in carbon tetrachloride to wash the remaining dyestuff off the material. The final cleaning takes place in clean carbon tetrachloride. The film is subsequently dried for 15 minutes in a drying cabinet with air circulation at 30° C.

A positive image is obtained.

EXAMPLE 3

A screen positive on vesicular film (Kalvar film, type 10) pre-treated as in example 1 is immersed at 25° C in a dyestuff solution containing 2 g Oracetblue 3B (Colour Index No. 64500), 2.5 g fat-soluble red 7B (Colour Index No. 26050) and 2 g Orasol yellow GN (Colour Index No. 18690) per 100 ml 2-ethoxy-ethanol. After 18 minutes the film is dipped twice for 20 seconds and once for 15 seconds in fresh 2-ethoxy-ethanol.

The film is subsequently immersed several times in a bath of 1,1,1-trichloroethane and then dried as in example 2.

A neutral grey screen positive is obtained.

EXAMPLE 4

A half-tone positive on vesicular film (Kalvar film, type 10) pre-treated as in example 1 is immersed at 25° C in a dyestuff solution containing 2 g fat-soluble red 7B (Colour Index No. 26050) per 100 ml 2-ethoxy-ethanol. After 15 minutes the film is dipped twice for 20 seconds and once for 15 seconds in fresh 2-ethoxy-ethanol.

The film is subsequently immersed several times in a bath of 1,1,1-trichloroethane and then dried at 30° C for 15 minutes in a drying cabinet with air circulation. A positive image is obtained.

EXAMPLE 5

A vesicular film (Kalvar film, type 16) exposed and developed behind a line screen is immersed for 5 minutes at 30° C in a 1% solution of Cerese yellow GRN (Colour Index No. 21230) in 2-ethoxy-ethanol.

The film is then washed twice for 10 seconds in quick succession with 2-ethoxy-ethanol at 20° C and the remaining dyestuff subsequently rinsed off with carbon tetrachloride. Drying as in example 1. The resolution of the original vesicular image and transformed image is 114 lines/mm. The optical density is 0.20 to 0.92 for the vesicular image and 0.29 to 2.43 for the coloured image.

EXAMPLE 6

A vesicular half-tone image (Kalvar type 10) is placed for 30 minutes at 20° C in a 2-ethoxy-ethanol soltuion, which contains 3 g Oracetblue B3 (C.I. Solvent Blue 19), 3 g Orasol yellow GN (C.I. Solvent Yellow 23) and 3 g fat-soluble red 7B (Colour Index 26050) per 100 ml.

The film is washed three times for 10 seconds in quick succession with 2-ethoxy-ethanol, and then treated twice with carbon tetrachloride. Drying is as described in example 1. Resolution of the original vesicular image is 161 lines/mm, of the coloured image 114 lines/mm. The optical density (white light, transmission) of the vesicular image is 0.07 to 0.46; that of the transformed image 0.58 to 1.39.

EXAMPLE 7

A half-tone positive on vesicular film (Kalvar film, type 10) is immersed for 13 minutes at 25° C in a solution containing 1 g Orasol yellow GN (Colour Index No. 18690) per 100 ml 2-ethoxy-ethanol. After this time the film is dipped twice for 20 seconds and once for 15 seconds in fresh 2-ethoxy-ethanol, subsequently immersed several times in a bath of 1,1,1-trichloroethane and dried as indicated in example 1. A positive yellow image is obtained.

EXAMPLE 8

A vesicular half-tone positive (Kalvar film, tyep 10) is immersed for 13 minutes at 25° C in a solution of 2-ethoxyethanol, which contains 2 g Oracetblue B (Colour Index No. 64500) per 100 ml solvent. The film is subsequently treated as described in example 7. A positive image is obtained.

EXAMPLE 9

A freshly developed and fixed half-tone positive vesicular film (Kalvar film, type 10) is immersed at 25° C in a dyestuff solution, which contains 2 g Oracetblue B (Colour Index 64500), 2.5 g fat-soluble red 7B (Colour Index 26050) and 2 g Orasol yellow GN (Colour Index 18690) per 100 ml 2-ethoxy- ethanol.

After 28 minutes the film is washed several times with 2-ethoxyethanol, immediately immersed in 1,1,1-trichloroethane and then washed three times with fresh 1,1,1-trichloroethane. The washed film is subsequently dried for 15 minutes at 30° C in a drying cabinet with air circulation.

EXAMPLE 10

A vesicular film (Kalvar type 10) is treated for 15 minutes at 20° C in a solution of 2.5 g of an optical brightner, e.g. bis-(5-methylbenzoxazolyl)-ethylene in 100 ml 2-ethoxy-ethanol. The film is then washed once for 15 seconds in 2-ethoxy-ethanol and then for 30 seconds with carbon tetrachloride. The film is dried for 20 minutes at 30° C in a drying cabinet with air circulation.

The emulsion side of the film is then rubbed with a soft cloth.

The image becomes visible under the UV lamp at 350 nm.

EXAMPLE 11

Silver images corresponding to the yellow, red and blue separations of a colour original are copied on to vesicular films (Kalvar type 10).

a. The copy of the yellow separation is treated for 8 minutes at 20° C in a solution of 1.5 g Orasol yellow GN (Colour Index Solvent Yellow 23) in 100 ml 2-ethoxy-ethanol. The copy is then washed three times for 10 seconds with 2-ethoxy-ethanol and subsequently with $ccl_4$, and dried as in example 1.
b. The red separation is placed for 10 minutes at 20° C in a 2% solution of fat-soluble red 7B (Colour Index 26050) in 2-ethoxy-ethanol and also after-treated.
c. The blue separation is placed for 12 minutes in a 2% solution of Oracet blue B (Solvent Blue 19) in 2-ethoxy-ethanol and also after-treated.

By superimposing the three transformed images on each other an image in natural colours is obtained. The optical density of the yellow image is 0.19 to 1.0, that of the red image 0.29 to 1.36 and that of the blue image 0.20 to 0.83.

EXAMPLE 12

Silver images corresponding to the yellow, red, blue and black separations of a colour original, are copied on to vesicular films (Kalvar film, type 10).

a. The yellow separation is treated for 8 minutes at 25° C in a solution of 1 g Orasol yellow GN (Colour Index 18690) in 100 ml 2-ethoxy-ethanol. It is then washed three times for 10 seconds with 2-ethoxy-ethanol and subsequently with 1,1,1-trichloroethane and dried as in example 15.
b. The red separation is placed for 10 minutes at 25° C in a 2% solution of fat-soluble red 7B (Colour Index 26050) in 2-ethoxy-ethanol and after treated as described under a).
c. The blue separation is placed for 12 minutes at 25° C in a 2% solution of Oracetblue B (Colour Index 64500) in 2-ethoxy-ethanol and after-treated as described under a).
d. The black separation is immersed for 20 minutes at 25° C in a dyestuff solution containing 2 g Oracetblue B (Colour Index 64500), 2.5 g fat-soluble red 7B (Colour Index 26050) and 2 g Orasol yellow GN (Colour Index 18690) per 100 ml 2-ethoxy-ethanol. The film is washed several time with 2-ethoxy-ethanol, subsequently immersed in 1,1,1-trichloroethane and washed with fresh 1,1,1-trichloroethane. The washed film is dried as in example 15.

An image in natural colours is obtained by superimposing the four images.

EXAMPLE 13

A developed and fixed vesicular film (Kalvar film, type 10) is placed for 12 seconds at room temperature in a dyestuff solution containing 3 g Oracetblue B (Colour Indes 64500) per 100 ml methylene chloride. The film is quickly transferred to a moving solution of 1,1,1-trichloroethane and immersed for 5 seconds. It is then washed three times with 2-ethoxy-ethanol, rinsed with 1,1,1-trichloroethane, the solvent allowed to evaporate in air and the substrate smoothed over acetone vapour. The film is then dried as in example 1.

A positive blue image is obtained.

EXAMPLE 14

A developed and fixed vesicular film (Kalvar film, type 10) is immersed at room temperature for 10 seconds in a dyestuff solution containing 3 g fat-soluble red 7B (Colour Index 26050) per 100 ml methylene chloride. The film is immediately immersed in 1,1,1-trichloroethane for 5 seconds.

The film is subsequently washed three times with 2-ethoxy-ethanol and swelling blocked with 1,1,1-trichloroethane. The film is allowed to dry briefly in air, the emulsion side smoothed over acetone vapour and the film dried as in example 1.

A positive red image is obtained.

EXAMPLE 15

Silver images corresponding to the yellow, red, blue and black separations of a colour original are copied on to vesicular films (Kalvar film, type 10).

a. The yellow separation is immersed for 8 seconds at room temperature in a solution containing 1 g Orasol yellow GN (Colour Index 18690) per 100 ml methylene chloride. The film is quickly transferred into agitated 1,1,1-trichloroethane and briefly immersed. The film is then washed several times with 2-ethoxy-ethanol and subsequently with 1,1,1-trichloroethane. After briefly drying in air the substrate is smoothed with acetone vapour and the film dried as in example 1.
b. The red separation is immersed for 10 seconds at room temperature in a solution containing 3 g fat-soluble red 7B (Colour Index 26050) in 100 ml methylene chloride, and further treated as described under a).
c. The blue separation is immersed for 10 seconds at room temperature in a solution containing 3 g Oracetblue B (Colour Index 64500) per 100 ml methylene chloride, and further treated as described under a).

d. The black separation is immersed for 28 minutes at 25° C in a solution containing 1 g Orasol yellow GN (Colour Index 18690), 2.5 g fat-soluble red 7B (Colour Index 26050) and 2 g Oracetblue B (Colour Index 64500) per 100 ml 2-ethoxy-ethanol. The film is then washed several times with fresh 2-ethoxy-ethanol, rinsed twice with carbon tetrachloride and dried as described in example 1.

An image in natural colours is obtained by superimposing the four transformed images on each other.

EXAMPLE 16

A photographic paper (Kalvar paper type 90; Saran base) is immersed at room temperature for 12 minutes in a solution containing 1 g anthracene per 100 ml 2ethoxy-ethanol. The paper is then rinsed once with 2-ethoxy-ethanol washed, twice with carbon tetrachloride and dried for 15 minutes in a drying cabindet with air circulation at 30° C. cabinet The image becomes visible under the UV lamp at 350 nm.

EXAMPLE 17

A developed and fixed vesicular image (Kalvar film type 10) is immersed for 40 seconds in a solution containing 1.5 g fat-soluble red 7B (Colour Index 26050) per 100 ml 2-methoxy-ethanol. The film is quickly immersed in 1,1,1-trichloroethane in order to block the swelling, and subsequently washed twice in 2-ethoxy-ethanol and rinsed with carbon tetrachloride. The solvent is evaporated in air, the pores closed over acetone vapour and the film dried for 5 minutes at 30° C in a drying cabinet with air circulation. A positive red image is obtained.

EXAMPLE 18

A vesicular image (Kalver film, type 10) is immersed for 30 seconds at 24° C in a solution containing 1.5 g fat-soluble red 7B (Colour Index 26050) per 100 ml 2-methoxy-ethanol. The film is then immersed quickly in ethanol and washed once with this solvent. The film is placed twice for 10 seconds in a motionless solution of 2-ethoxy-ethanol, the emulsion side being rinsed each time with a solvent. Immediately thereafter the film is immersed in ethanol and washed. The ethanol is allowed to evaporate in air, the pores closed over acetone vapour and the film dried as in example 17. A positive red image is obtained.

EXAMPLE 19

A vesicular image (Kalvar film, type 10) is immersed for 45 seconds at 24° C in a solution containing 2.5 g fat-soluble red 7B (Colour Index 26050) per 100 ml 2-methoxy-ethanol. The film is immediately immersed in 1,1,1-trichloroethane and washed again with the latter. The film is then left for 20 seconds in static 2-ethoxy-ethanol, rinsed with the same solvent on the emulsion side and immersed in 1,1,1-trichloroethane, then washed with ethanol and dried in air. The pores of the dry film are closed with acetone vapour, and the film subsequently dried as in example 17. A positive red image is obtained.

EXAMPLE 20

A vesicular image (Kalvar film, type 10) is immersed for 50 seconds at 20° C in a solution containing 1 g Orasol yellow GN (Colour Index 18690) and 2 g Oracetblue B (Colour Index 18690) and 2 g Oracetblue B (Colour Index 64500) per 100 ml 2-methoxy-ethanol.

The film is then immersed three times in 2-ethoxy-ethanol and immediately washed with ethanol. After evaporation of the alcohol, the pores are closed over acetone vapour and the film dried as in example 17. A positive green image is obtained.

EXAMPLE 21

A developed and fixed vesicular, half-tone positive (Kalvar film, type 10) is immersed for 30 seconds at room temperature in 2-methoxy-ethanol and immediately dipped in ethyl alcohol. The film is dried for 5 minutes at 30° C in a drying cabinet with air circulation. The film is subsequently immersed for 15 minutes in a wetting agent solution containing 1 g surfactant with the formula:

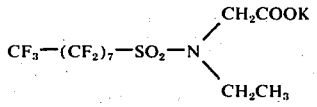

per 100 ml water. The still moist film is then treated for 15 minutes in a dyestuff solution of 1 g malachite green (Colour Index 42000) per 100 ml water.

The film is then dabbed on both sides with an absorbent fabric and the excessive dyestuff dissolved by immersing the film several times in 2-ethoxy-ethanol. The film is next treated with 1,1,1-trichloroethane. After evaporation of this solvent the pores are closed over acetone vapour and the film dried as in example 17.

A positive green image is obtained.

EXAMPLE 22

A developed and fixed vesicular screen positive (Kalvar film, type 10) is immersed for 25 seconds at room temperature in 2-methoxy-ethanol and subsequently dipped in ethyl alcohol.

Further treatment takes place as in example 21, and a positive green image is obtained.

EXAMPLE 23

A vesicular half-tone positive (Kalvar film, type 10) is immersed for 30 seconds at room temperature in 2-methoxy-ethanol and subsequently dipped in ethyl alcohol.

Further treatment takes place as described in example 21, but a dyestuff solution of 1 g fuchsin NB (Colour Index 42520) per 100 ml dyestuff solution is selected.

A positive red image is obtained.

EXAMPLE 24

A developed and fixed vesicular positive (Kalvar film, type 10) is immersed for 30 seconds in 2-methoxy-ethanol. The film is quickly transferred to ethanol, moved and again rinsed with ethanol.

After evaporation of the alcohol the film is immersed for 15 minutes in a solution containing 1 g of surfactant with the formula:

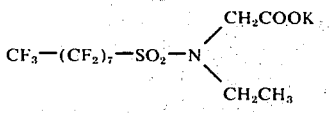

per 100 ml water.

The still moist film is then immersed for 10 minutes in an agitated bath of red Indian ink (Gunther Wagner AG, Pelikan No. 517). The film is subsequently dabbed on both sides with an absorbent fabric and dipped twice for 5 seconds in fresh 2-ethoxy-ethanol.

The film is immediately transferred into 1,1,1-trichloroethane and again rinsed with the same fresh solvent. After evaporation of the solvent the pores are closed over acetone vapour and the film dried as in example 17.

A positive red image is obtained.

EXAMPLE 25

A developed and fixed vesicular positive (Kalvar film, type 10) is dipped for 25 seconds in 2-methoxy-ethanol and quickly immersed in agitated ethanol.

After treatment for 15 seconds the film is rinsed with ethanol and dried. The dry film is then immersed for 15 minutes in a solution containing 1 g of a cationic wetting agent per 100 ml water.

After the film has been dried it is immersed for 12 minutes in a solution containing 1.5 g dyestuff with the formula:

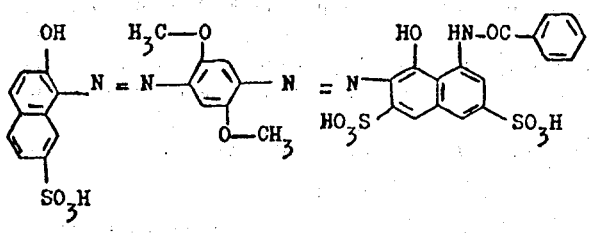

per 100 ml water.

The film is subsequently washed for 15 seconds in running cold water and rinsed with ethanol. After evaporation of the alcohol the pores are closed over acetone vapour, and the film is dried as in example 17.

A positive blue image is obtained.

EXAMPLE 26

A vesicular half-tone image (Kalvar film, type 10) is placed for 2 minutes in 2-methoxy-ethanol. It is subsequently treated for 20 seconds in ethanol and allowed to dry in air. The film is then shaken for 10 minutes in a 1% aqueous solution of a mixture of sodium dibutyl naphthalene sulphonate and sodium dinaphthylphthalein sulphonate (wetting agent) and treated for 5 minutes in a 1% aqueous solution of malachite green (Colour Index 4200). It is then dried at 30° C. The film carries a green image and also has a diffusive character. The uncoated side of the film is then allowed to run over a roller for 1 second, at 120° C. The film is then washed for 10 minutes with ethyl alcohol to remove dyestuff residues and dried in the drying cabinet at 30° C.

The pores are closed by brief treatment in dimethyl formamide vapour, and a non-diffusive green image is obtained.

EXAMPLE 27

The procedure is as in example 25. The still markedly diffusive coloured image obtained after drying at 30° C is immersed for a few seconds in dioxane and dried, a completely clear coloured image being produced.

EXAMPLE 28

A vesicular half-tone image (Kalvar film, type 10) is pre-treated with 2-methoxy-ethanol and methanol to transform the bubble image into an image with open pores, then immersed in a solution of the wetting agent of the composition described in example 26, and dipped for 5 minutes in a solution of silver nitrate and ferri-ammonium citrate. After short exposure with UV light photolytic silver, which can be intensified in a known way by physical development, is obtained in the pores. Copper can also be deposited on this silver image by glavanic methods.

EXAMPLE 29

A vesicular screen image (Kalvar film, type 10) is treated as in the previous example with methoxy-ethanol, methanol and subsequently with the wetting agent specified in example 21. It is then dipped successively in a lead nitrate and sodiuum sulphide solution. A stable, high-density image is produced by closing the pores in dimethyl formamide vapour.

EXAMPLE 30

An image is copied, developed but not fixed on a vesicular film (Kalvar film, type 10). Colouring takes place as in example 17 with a red dyestuff in a lipophilic solvent. A second image is then copied and developed a second time. The bubbles are then opened to form pores by the method described in example 26, and finally the film is dipped in an aqueous malachite green solution containing 1 % of the wetting agent specified in example 26. After the final treatment as in example 26 a two-colour image is obtained.

EXAMPLE 31

A developed and fixed vesicular image (Kalvar film, type KDR - 17) is immersed for 10 seconds at 20° C in a solution containing 3 g Cerese yellow GGN (Colour Index 110121) per 100 ml methylene chloride.

The film is transferred quickly into 2-ethoxy-ethanol and dipped twice in the same fresh solvent.

The film is subsequently washed in 1,1,1-trichloroethane, briefly dried in air and the emulsion side smoothed over acetone vapour. The film is then dried for 10 minutes at 30° C in a drying cabinet with air circulation. A positive red image is obtained.

EXAMPLE 32

A vesicular image (Kalvar film, type KDR - 17) is immersed for 12 seconds at 16° C in a solution containing 3 g Cerese yellow GGN (Colour Index 110121) per 100 ml methylene chloride.

The film is then immersed quickly in carbon tetrachloride and washed twice with 1,1,1The film is dried in air and the emulsion side smoothed over acetone vapour. The film is dried as described in example 31. A positive red image is obtained.

EXAMPLE 33

A developed and fixed vesicular image (Kalvar film, type KDR - 17) is immersed for 15 seconds at room temperature in a dyestuff solution containing 1 g Oracet blue B (Colour Index 64500) per 100 ml methylene chloride.

The film is quickly transferred to 1,1,1-trichloroethane and washed three times with the same fresh solvent.

After evaporation of the solvent the emulsion side is smoothed over acetone vapour and the film dried as in example 31.

A positive blue image is obtained.

EXAMPLE 34

A developed and fixed vesicular image (Kalvar film, type KDR - 17) is immersed for 14 seconds at 20° C in a solvent mixture of equal parts of methylene chloride and acetone, which contains 1.5 g Cerese yellow GGN (Colour Index 110121) per 100 ml.

The film is then quickly transferred into 1,1,1-trichloroethane and washed twice with the same fresh solvent.

After evaporation of the solvent the emulsion side is smoothed over acetone vapour and the film dried as in example 31.

A positive image is obtained.

EXAMPLE 35

A normally developed and fixed vesicular film (Kalvar film, type 10) is immersed for 30 seconds at room temperature in a solution of 2-methoxy-ethanol, immediately transferred into agitated ethanol and rinsed once with the latter.

The dry film is subsequently immersed for 15 minutes in a solution containing 1 g of the surfactant specified in example 21 per 100 ml water.

The film is then immersed for 15 minutes in aqueous malachite green solution (Colour Index 42000) containing 3 g dyestuff per 100 ml, rinsed for 5 seconds and immersed three times for 10 seconds in 2-ethoxy-ethanol. The film is quickly transferred into 1,1,1-trichloroethane and rinsed with the same fresh solution.

After evaporation of the solvent the pores are closed over acetone vapour.

A green positive image is obtained.

EXAMPLE 36

A vesicular film (Kalvar film, type 10) is immersed for 40 seconds at 20° C in cyclohexanone and immediately transferred into agitated methyl alcohol. After 10 seconds treatment the film is again rinsed with methanol.

The dry film is treated for 5 minutes in an agitated solution of 1 g of the surfactant specified in example 21 per 100 ml water.

The film is then immersed for 4 minutes in a solution containing 3 g malachite green (Colour Index 42000) per 100 ml water.

The still moist film is dipped twice for 5 seconds in 2-ethoxy-ethanol and washed once with 1,1,1-trichloroethane.

After evaporation of the solvent the pores are closed over acetone vapour and the film dried as in example 17.

A green positive image is obtained.

EXAMPLE 37

An exposed and developed vesicular film (Kalvar film, type 10) is treated with 2-methoxy-ethanol and subsequently with ethanol for opening the pores, and then hydrophilised with the surfactant mixture specified in example 21. A phthalocyanine blue pigment is then dusted on, the film wiped with cotton wool and the pores closed over acetone vapour.

A blue positive image is obtained.

I claim:

1. A method for modifying a vesicular image present in a hydrophobic thermoplastic layer selected from the group consisting of polyvinylidene chloride, polymethacrylonitrile, polystyrene and polyepoxide polymers and co-polymers made from acrylonitrile with ethyl acrylate and co-polymers of acrylonitrile with vinylidene chloride into a non-light-scattering image which method comprises a. opening the closed bubbles of the vesicular image to form an open-pore image by allowing at least one organic lipophilic solvent which attacks the thermoplastic bubble walls of the vesicular image to act on the latter, b. introducing the image substance selected from the group consisting of dyestuffs, optical brighteners and ultraviolet absorbers into the open pores by treatment with a solution in a hydrophilic solvent or with a dispersion of the image substance, c. removing the excess adhereing image substance solution by briefly flushing with water, and d. removing any remaining gas bubbles or closing the pores by a heat treatment or a treatment with a highly volatile organic solvent and drying the image material.

2. Method according to claim 1 which comprises using a dyestuff as image substance.

3. Method according to claim 1 which comprises using an ultraviolet absorber or an optical brightener as image substance.

4. Method according to claim 1, which comprises using a lipophilic solvent to open the bubbles and a hydrophilic solvent to dissolve the image substance.

5. Method according to claim 1, which comprises wetting the open pore image with a surfactant and treating the image thereafter with an aqueous solution of the image substance.

6. Method according to claim 1, which comprises using a water-soluble dyestuff as image substance.

7. Method according to claim 1, which comprises opening the bubbles by immersion in vapour from acetone, methylene chloride or dimethyl formamide for 1 to 20 seconds.

* * * * *